US005463784A

United States Patent [19]

Alpern

[11] Patent Number: 5,463,784

[45] Date of Patent: Nov. 7, 1995

[54] HAND RAIL ATTACHMENT FOR BEDS

[76] Inventor: Erwin A. Alpern, 5040 Fulton St., N.W., Washington, D.C. 20026

[21] Appl. No.: 291,850

[22] Filed: Aug. 17, 1994

[51] Int. Cl.[6] ..... A47C 21/08

[52] U.S. Cl. ..... 5/430; 5/426; 5/662

[58] Field of Search ..... 5/425, 426, 428, 5/430, 662; 297/411.31; 49/394; 182/106

[56] References Cited

U.S. PATENT DOCUMENTS

| | | | |
|---|---|---|---|
| 825,681 | 7/1906 | Rooney | 5/430 |
| 2,555,228 | 5/1951 | Evers | 5/426 |
| 2,904,799 | 9/1959 | Berlin | 5/426 |
| 3,057,638 | 10/1962 | Floyd | 297/411.31 |
| 4,013,135 | 3/1977 | Kechely | 297/441.31 |

FOREIGN PATENT DOCUMENTS

| | | | |
|---|---|---|---|
| 1200067 | 7/1970 | United Kingdom | 49/394 |

*Primary Examiner*—Flemming Saether

*Attorney, Agent, or Firm*—Crickenberger & Associates

[57] ABSTRACT

A hand rail attachment for beds comprises an upstanding side member connected to a base member adapted to fit under a bed mattress. The side member is in the form of an inverted U-shape with adjustably mounted cross-members mounted between the depending arms of the U-shape. The end of one depending arm has a pivot pin mounted therein, and the other end has a slidable sleeve attached thereto. The base member has upstanding end portions, one of which receives the pivot pin, and the other of which abuts the end of the other depending arm having the slidable sleeve which slides over the abutting connection and locks the upstanding side member to the base member. The base member has elongated U-shaped support members mounted at either end thereof to extend under the bed mattress. When used in opposing pairs, the base member of the second hand rail attachment has a wide U-shaped support member designed to fit between the elongated U-shaped support members of the first hand rail attachment in complementary configuration.

5 Claims, 4 Drawing Sheets

HAND RAIL ATTACHMENT FOR BEDS

BACKGROUND OF THE INVENTION

The present invention relates to a hand rail attachment for beds that provides a support structure for the bed occupant to utilize in climbing in and out of the bed and in shifting positions while in the bed. The attachment also functions as a guard rail that pivots in and out of position to permit ready access for making the bed and ministering to the needs of the bed occupant.

Devices of the same general nature are known in the art, but none of them combine the novel features of the present invention. Examples of the prior art devices are shown in the following United States patents:

| | | |
|---|---|---|
| 5,038,430 | 08/13/91 | Bly |
| 4,724,559 | 02/16/88 | Bly, et al. |
| 3,616,469 | 11/02/71 | Injeski |
| 3,474,473 | 10/28/69 | Hannaberg |
| 2,904,799 | 09/22/59 | Berlin |
| 2,648,850 | 08/18/53 | Warren |

The patent to Warren shows a typical guard rail that can be removably mounted on a variety of bed rails. The patents to Injeski, Hannaberg, and Berlin disclose guard rail attachments that are positioned under and held in place by the bed mattress, a feature also utilized by the present invention. The patents to Bly and Bly, et al., disclose guard rails with novel attachment means and telescoping rails that are selectively adjustable. Spring-biased locking means are provided to fix the rails in position.

The prior art devices do not provide a convenient vertically adjustable rail structure that pivots in and out of position as need for access to the bed.

SUMMARY OF THE INVENTION

In accordance with the present invention, a hand rail attachment for beds comprises an inverted U-shaped tubular member disposed in a vertical plane along the side of a bed. A cross-member extends between and is attached to the depending arms of the inverted U-shaped tubular member. A base member is provided to slide under the bed mattress and be held in position by the mattress and the weight of the bed occupant. Upstanding end portions of the base member having cross-sectional shapes similar to the ends of the inverted U-shaped tubular member are adapted to abut the ends of the side member.

A pivot pin member is fixedly mounted in the end of one of the depending arms of the inverted U-shaped tubular member. This pin member fits into one of the upstanding end portions of the base member to form a pivotal connection. A tubular sleeve member is attached to the other depending arm of the inverted U-shaped tubular member by a short flexible cable. The flexible cable permits the sleeve member to slide along the end of the depending arm and lock the side member to the base member when the end of the inverted U-shaped tubular member abuts the upstanding end portion of the base member and the abutting portions are covered by the sleeve member.

A plurality of cross-members extend between the depending arms of the inverted U-shaped tubular member to provide structural stability and to provide additional support means to be grasped by the bed occupant in shifting position in the bed. The cross-members are vertically adjustable to suit the needs of the bed occupant.

The novel features that are considered to be characteristic of the invention are set forth in particular in the appended claims. However, the invention itself, both as to construction and method of operation, will be understood best from the following description of the preferred mode for carrying out the invention, when read in connection with the accompanying drawings.

BRIEF DESCRIPTION OF THE DRAWINGS

The invention will now be described by way of example and with reference to the accompanying drawings in which.

DESCRIPTION OF THE INVENTION

Figure 1:
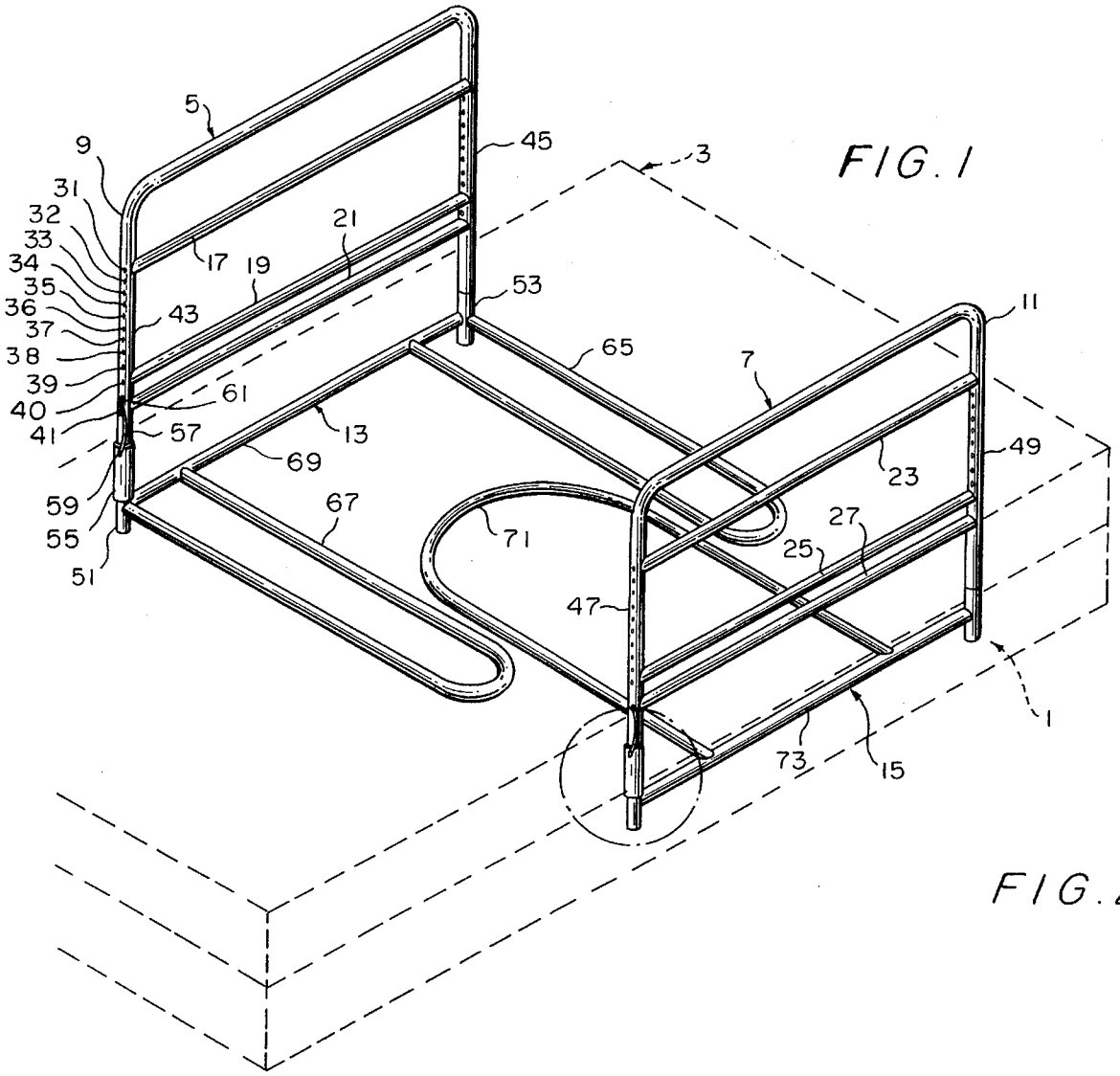
FIG. 1 is a perspective view of an embodiment of the invention in which complementary hand rail attachments are mounted in position under a bed mattress.

In FIG. 1, a bed is shown in outline form comprising a box spring 1 with a mattress 3 laying thereupon. A pair of hand rail attachments 5 and 7 are held in position on either side of the bed by the mattress 3. The hand rail attachments 5 and 7 comprise a pair of members shown generally at 9 and 11, respectively, mounted in base members designated generally by the numerals 13 and 15.

Figure 2:
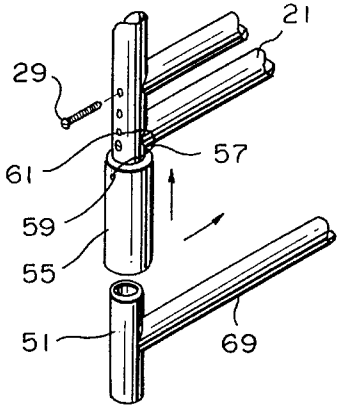
FIG. 2 is a detailed perspective view showing the locking sleeve arrangement that holds the side member in position abutting the end portion of the base member.
Figure 4:
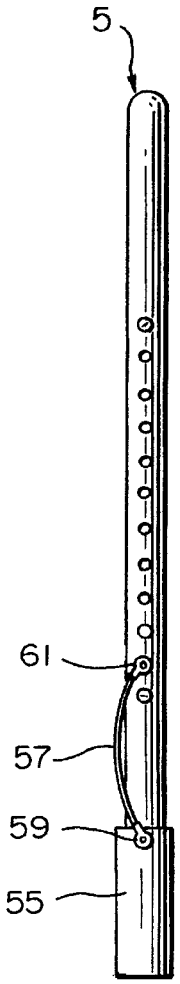
FIG. 4 is a side elevation of the inverted U-shaped tubular member shown in FIG. 3.

Side member 5 includes a plurality of cross-members 17, 19, and 21. Side member 7 includes cross-members 23, 25, and 27. All of the cross-members are removable mounted by fasteners as shown at 29 in the detailed view of FIG. 2, so that the cross-members may be adjustably positioned to suit the needs of the bed occupant in providing a conveniently located gripping means for the occupant to facilitate positioning on the bed. A plurality of holes, such as shown at 31 through 41 in FIG. 1 are provided to adjustably position the cross-members vertically along the depending inverted U-shaped tubular member shown at 43 and 45 on side member 5 and at 47 and 49 on side member 7.

The depending inverted U-shaped tubular members 43 and 45 abut the end portions 51 and 53, which are of similar cross-sectional shape so that tubular sleeve member 55 can slide over the abutting junction of the two members and lock them in position. Flexible cable 57 is attached to sleeve member 55 at 59 and, in turn, is fastened to depending inverted U-shaped tubular member 43 at 61, thereby allowing limited slidable movement of sleeve member 55 sufficient to perform the locking function. The structure of side member 7 is similar.

Figure 3:
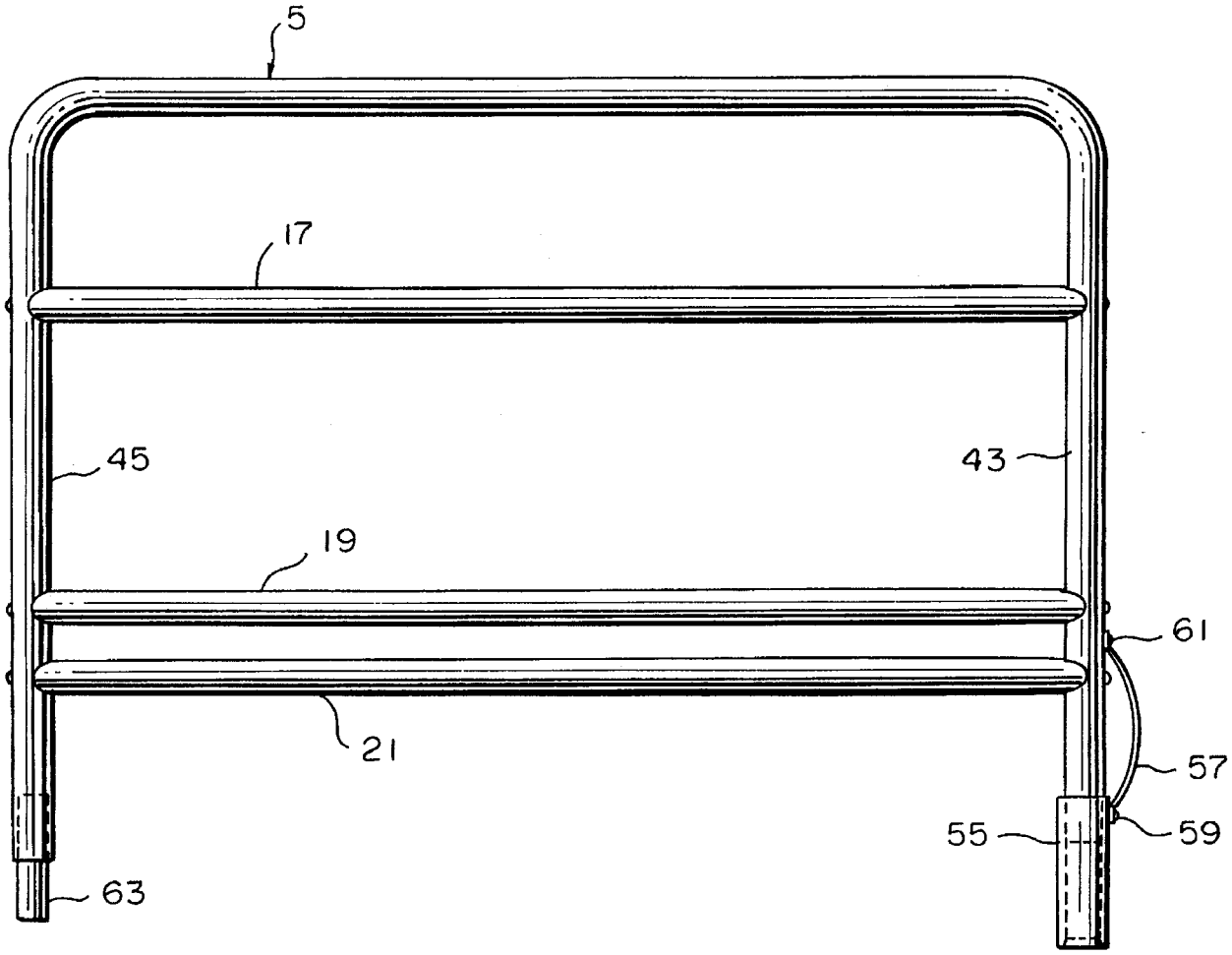
FIG. 3 is a front elevation view of the inverted U-shaped tubular member.
Figure 6:
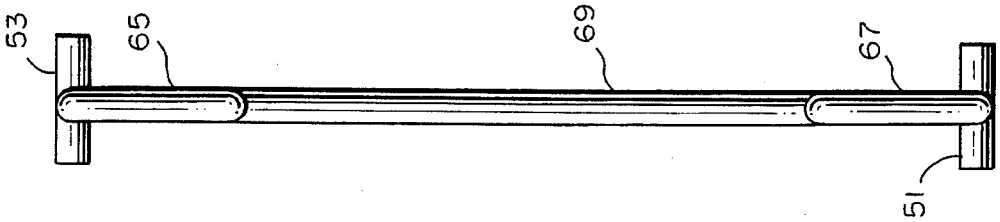
FIG. 6 is an end view of the first base member shown in FIG.

The depending inverted U-shaped tubular member 45 has a pivot pin member 63 affixed in the end thereof and extending downwardly therefrom. As shown in FIGS. 1 and 3, pivot pin member fits into the upstanding end portion 53 of base member 13 to form a pivotal connection, thereby permitting side member 9 to pivot from a closed to an open position and back as sleeve member 55 is lifted from its locking position. Side member 7 is similarly constructed.

Figure 5:
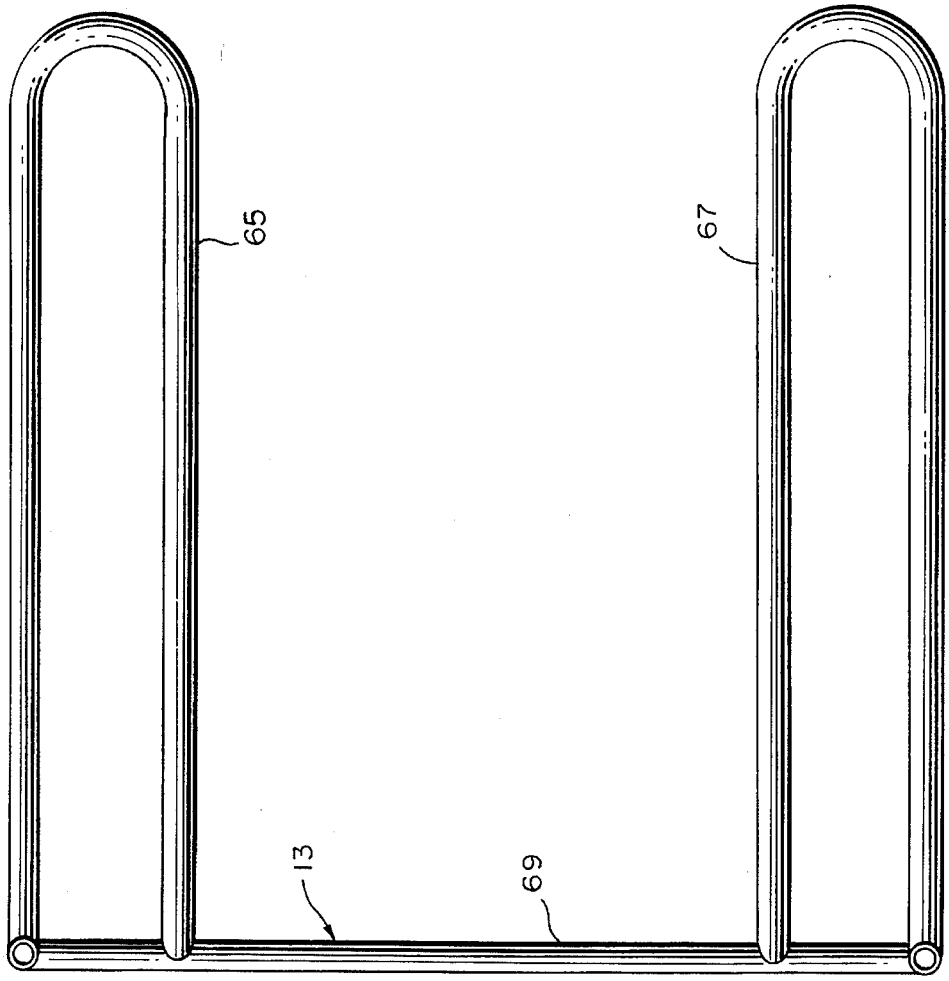
FIG. 5 is a plan view of a first base member.
Figure 8:
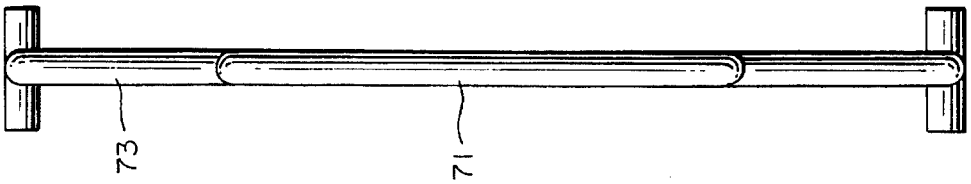
FIG. 8 is an end view of the second base member shown in FIG. 7.
Figure 7:
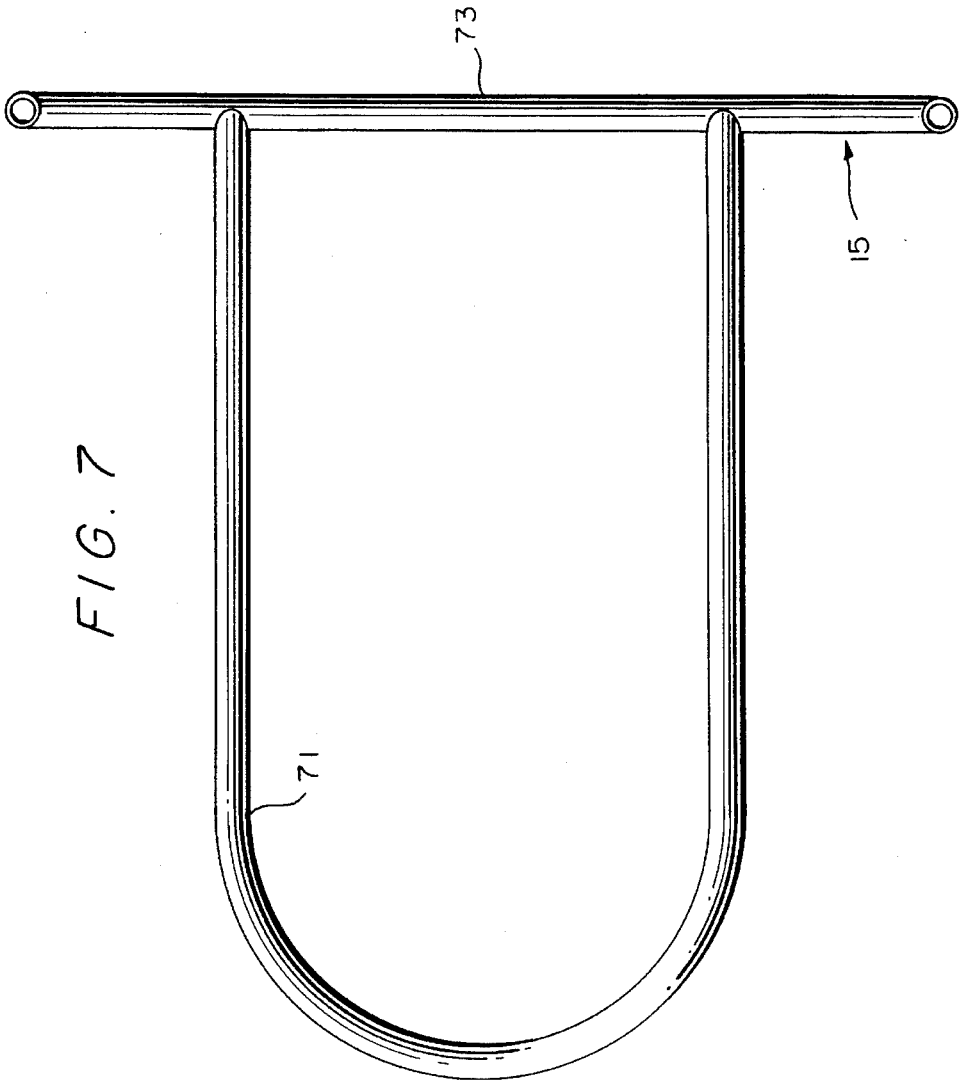
FIG. 7 is a plan view of a second base member of complementary shape to the first base member.

When it is desired to have the hand rail attachments opposingly mounted on the sides of a bed, the base members 13 and 15 are constructed with complementary shapes as shown in FIGS. 1, 5, and 7. Base member 13 has elongated U-shaped support members 65 and 67 fixedly attached to base cross-member 69 at either end thereof. Base member 15 has a wide U-shaped support member 71 centrally located in fixed position on base cross-member 73, the width thereof being such that it fits between the elongated U-shaped support members 65 an 67 of base member 13.

It will be obvious to those skilled in the art that modifications may be made to the preferred embodiment described herein without departing from the spirit of the invention, and the invention includes all such modifications.

What is claimed is:

1. A hand rail attachment for beds comprising an inverted U-shaped tubular member disposed in a vertical plane along the side of a bed and having a cross-member extending between and attached to the depending arms of the inverted U-shaped tubular member, said inverted U-shaped tubular member serving as both a guard rail and a hand-support rail for the bed occupant;

a base member adapted to be inserted in a horizontal plane between the bed mattress and the box spring for receiving and supporting the vertically depending arms of the inverted U-shaped tubular member;

said base member including upstanding end portions of cross-sectional shape similar to the ends of the inverted U-shaped tubular member, whereby the ends of the inverted U-shaped tubular member abut the upstanding end portions of the base member in flush relationship;

a pivot pin member fixedly mounted in the end of one of the depending arms of the inverted U-shaped tubular member and projecting therefrom to engage one of the upstanding end portions of the base member in telescopic relationship, thereby maintaining the depending arm and the upstanding end portion in vertical alignment while permitting pivotal movement between the respective members;

a tubular sleeve member slidably positioned on the other depending arm of the inverted U-shaped tubular member and adapted to slide over the other upstanding end portion of the base member while remaining partially in position on the inverted U-shaped tubular member, thereby securing the inverted U-shaped tubular member in an upstanding relationship with respect to the bed mattress;

whereby a stable hand rail is provided by the inverted U-shaped tubular member when the sleeve member is secured in said first position and the inverted U-shaped tubular can be pivoted away from the bed to permit easy access to and from the bed when the sleeve member is secured in said second position.

2. The combination according to claim 1 wherein a plurality of cross-members extend between the depending arms of the inverted U-shaped tubular member.

3. The combination according to claim 2 wherein the cross-members are adjustably attached to the depending arms of the inverted U-shaped tubular member, whereby their respective vertical positions can be changed in accordance with the preferences of the bed occupant.

4. The combination according to claim 3 comprising first and second hand rail attachments positioned on opposite sides of the bed, the base members of said first and second hand rail attachments having complementary configurations whereby each base member extends substantially across the width of the bed to provide a stable hand rail attachment on both sides of the bed.

5. The combination according to claim 4 wherein the base member of said first attachment comprises a pair of support members positioned apart to allow a support member to be positioned between them, and the base member of said second attachment comprises a single support member adapted to fit between the pair of support members on the base of said first attachment.

* * * * *